US009927828B2

(12) United States Patent
Shukla et al.

(10) Patent No.: US 9,927,828 B2
(45) Date of Patent: Mar. 27, 2018

(54) SYSTEM AND METHOD FOR A LINEAR VOLTAGE REGULATOR

(71) Applicant: STMicroelectronics International N.V., Amsterdam (NL)

(72) Inventors: Hemant Shukla, Bangalore (IN); SaurabhKumar Singh, Noida (IN); Nitin Bansal, Gurgaon (IN)

(73) Assignee: STMicroelectronics International N.V., Amsterdam (NL)

( * ) Notice: Subject to any disclaimer, the term of this patent is extended or adjusted under 35 U.S.C. 154(b) by 105 days.

(21) Appl. No.: 14/841,476

(22) Filed: Aug. 31, 2015

(65) Prior Publication Data

US 2017/0060166 A1 Mar. 2, 2017

(51) Int. Cl.
*G05F 3/26* (2006.01)

(52) U.S. Cl.
CPC ..... *G05F 3/267* (2013.01)

(58) Field of Classification Search
CPC . G05F 1/575; G05F 1/46; G05F 1/468; G05F 1/56; G05F 3/267; G05F 3/26; H02M 3/33507; H02M 2001/0032; H02M 1/08; H02M 2001/0048; H02M 2003/1566; H02M 3/335; H02M 3/33523; H02M 3/33576; H02M 3/3376; Y02B 70/16; Y02B 70/1433
See application file for complete search history.

(56) References Cited

U.S. PATENT DOCUMENTS

| | | | | |
|---|---|---|---|---|
| 7,710,091 | B2 | 5/2010 | Huang | |
| 2008/0165465 | A1* | 7/2008 | Rallabandi | G05F 1/573 361/93.9 |
| 2011/0267017 | A1 | 11/2011 | Zhang et al. | |
| 2014/0015502 | A1 | 1/2014 | Chen | |
| 2015/0002110 | A1 | 1/2015 | Singh et al. | |
| 2015/0177753 | A1* | 6/2015 | Zegheru | G05F 1/468 323/313 |
| 2017/0060166 | A1 | 3/2017 | Shukla et al. | |

FOREIGN PATENT DOCUMENTS

| | | | |
|---|---|---|---|
| CN | 1882901 | A | 12/2006 |
| CN | 102789257 | A | 11/2012 |
| CN | 103543777 | A | 1/2014 |
| CN | 103576729 | A | 2/2014 |
| CN | 104731150 | A | 6/2015 |
| CN | 204538970 | U | 8/2015 |
| CN | 206075185 | U | 4/2017 |

* cited by examiner

*Primary Examiner* — Henry Lee, III
(74) *Attorney, Agent, or Firm* — Slater Matsil, LLP

(57) ABSTRACT

According to an embodiment, a voltage regulator includes a linear voltage regulator (LVR) and a transient feedback circuit. The LVR a primary feedback loop, an input terminal configured to receive an input voltage, and an output terminal configured to output a regulated voltage. The transient feedback circuit is coupled to the output terminal and the primary feedback loop, and is configured to provide a first current with a first polarity to the primary feedback loop when current flowing through the output terminal is increasing.

29 Claims, 8 Drawing Sheets

SYSTEM AND METHOD FOR A LINEAR VOLTAGE REGULATOR

TECHNICAL FIELD

The present invention relates generally to electronic circuits, and, in particular embodiments, to a system and method for a linear voltage regulator (LVR).

BACKGROUND

In the field of electronics, a linear regulator, or linear voltage regulator (LVR), is a system used to maintain a steady voltage at a node, such as an output node for supplying a load. Two general configurations of linear regulators include a series regulator, where the regulating device is located in series with the regulated load, and a shunt regulator, where the regulating device is located in parallel with the regulated load. A simple example of a linear regulator includes only a Zener diode and a series resistor. More complicated examples of linear regulators include separate stages for implementing voltage reference, error amplification, and power pass elements.

In a slightly more detailed example, a transistor is used in a linear regulator to establish the regulated output voltage. The output voltage is compared to a reference voltage to produce a control signal for the transistor which adjusts the current supplied through the transistor. Such linear regulators do not require magnetic devices such as inductors or transformers, which can be relatively expensive or bulky. Basic components used in many linear regulators include transistors, diodes, and resistors, which are readily fabricated using microfabrication techniques for integrated circuits.

Because linear regulators generally operate using a variable voltage drop to regulate voltage at an output node, the supply voltage provided to an input of the linear regulator is generally required to be at least some minimum amount higher than the desired output voltage at the regulated output node. This minimum voltage above the desired or target output voltage is often referred to as the dropout voltage. Thus, the minimum supply voltage is equal to the target regulated output voltage plus the dropout voltage. For example, linear voltage regulators with low dropout voltages are often referred to as low dropout regulators (LDOs).

Thus, many types of linear voltage regulators exist for providing regulated supply voltages in the presence of varying load conditions. These linear regulators may be implemented in an on-chip manner; however, due to stability and transient response requirements of the on-chip environment, an off-chip capacitor is often implemented as part of the voltage regulator. An off-chip capacitor increases manufacturing costs and space usage, and also prevents a fully on-chip implementation of a system. Off-chip capacitors often have capacitance values in the range of 500 nanofarad (nF) to 10 microfarad (μF) or higher.

SUMMARY

According to an embodiment, a voltage regulator includes a linear voltage regulator (LVR) and a transient feedback circuit. The LVR a primary feedback loop, an input terminal configured to receive an input voltage, and an output terminal configured to output a regulated voltage. The transient feedback circuit is coupled to the output terminal and the primary feedback loop, and is configured to provide a first current with a first polarity to the primary feedback loop when current flowing through the output terminal is increasing.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

Figure 1:
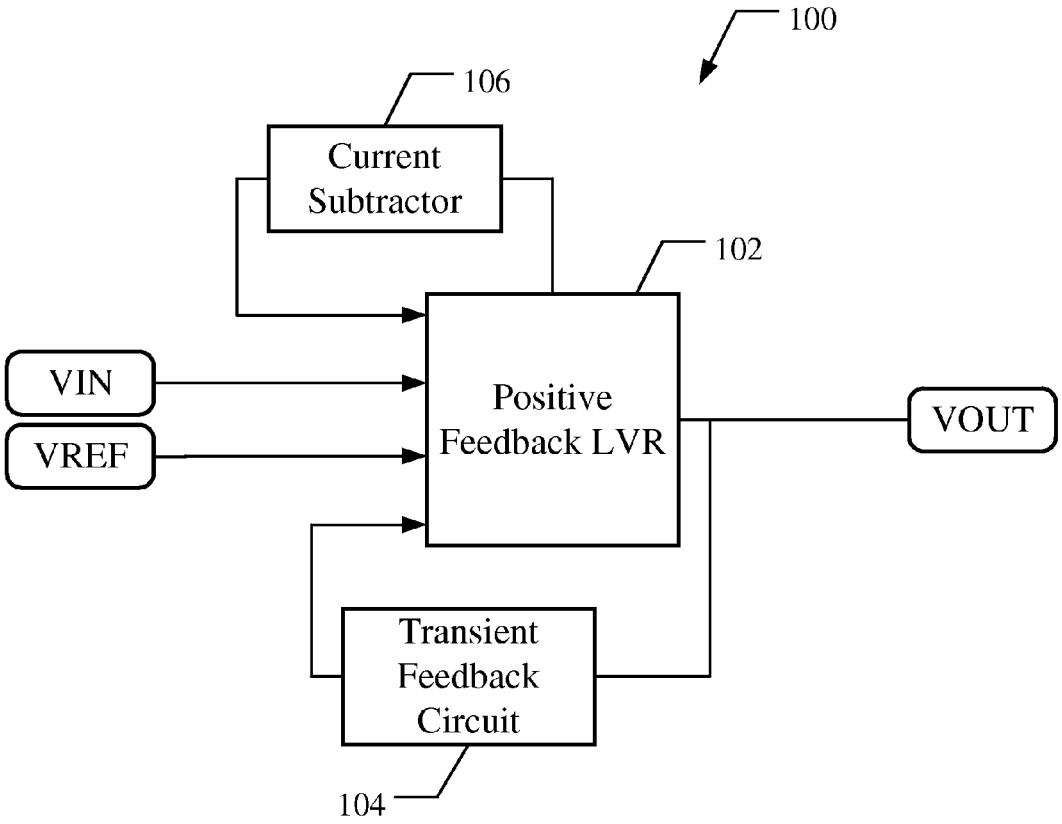
FIG. 1 illustrates a system block diagram of an embodiment linear voltage regulator.

The making and using of various embodiments are discussed in detail below. It should be appreciated, however, that the various embodiments described herein are applicable in a wide variety of specific contexts. The specific embodiments discussed are merely illustrative of specific ways to make and use various embodiments, and should not be construed in a limited scope.

Description is made with respect to various embodiments in a specific context, namely voltage regulators, and more particularly, linear voltage regulators (LVRs). Some of the various embodiments described herein include voltage regulators including a positive feedback loop, a transient enhancement circuit, a current subtractor, or a combination of such elements. Particular embodiments include voltage regulators with improved stability and transient response characteristics implemented as an on-chip integrated circuit without an off-chip output capacitor. In other embodiments, aspects may also be applied to other applications involving any type of electronic circuit according to any fashion as known in the art.

Linear voltage regulators implemented on an integrated circuit (IC) usually require a capacitor, for example, on the order of a microfarad, to be connected to the regulated output node external to the integrated circuit, i.e., an off-chip capacitor. This off-chip capacitor is necessary to maintain the stability of the regulated output voltage and improve transient performance of the on-chip voltage regulator. The requirement of the off-chip capacitor may add to the cost of the voltage regulator and prevents a fully integrated, or on-chip, implementation. Designs and techniques omitting the off-chip capacitor may require the output capacitance to be very small (for example, a few hundred picofarads) which may result in poor transient performance in some cases.

According to various embodiments, a voltage regulator is integrated on a chip without an off-chip capacitor. In such embodiments, a primary feedback loop is provided for regulating the output voltage at an output node that is configured to be coupled to a load. The primary feedback loop is supplied by a transient enhancement circuit that has a faster transient response time than the primary feedback loop and improves the transient response time of the voltage regulator. Further, a current subtractor is, alternatively to or in combination with the transient enhancement circuit, coupled to the primary feedback loop in order to improve stability of the voltage regulator by sinking excess current generated in response to varying load conditions.

In various embodiments, the primary feedback loop is a positive feedback loop. Examples and details relating to the implementation of such a positive feedback loop, especially in reference to a voltage regulator without an external off-chip capacitor, are described in U.S. patent application Ser. No. 13/929,549 to Singh et al., entitled "Voltage Regulator", and filed on Jun. 27, 2013, which is incorporated herein by reference in its entirety.

Various embodiments described herein include a voltage regulator implemented on a chip without an off-chip capacitor that exhibits improved transient response characteristics and improved stability.

FIG. 1 illustrates a system block diagram of an embodiment linear voltage regulator (LVR) 100 including a positive feedback LVR 102, a transient feedback circuit 104, and a current subtractor 106. According to various embodiments, positive feedback LVR 102 receives input voltage VIN and reference voltage VREF and generates regulated output voltage VOUT. Based on changes in regulated output voltage VOUT, positive feedback LVR 102 adjusts current within a positive current feedback loop in order to control output devices to supply more or less current and stabilize regulated output voltage VOUT. Input voltage VIN may be a supplied voltage that is regulated down to produce a stabilized voltage as regulated output voltage VOUT. Reference voltage VREF may be a target voltage for generating regulated output voltage VOUT. In various embodiments, the positive current feedback loop controls regulated output voltage VOUT based on reference voltage VREF. The positive current feedback loop may have a loop gain below 1 in order to ensure stability during operation. In alternative embodiments, positive feedback LVR 102 may be implemented with another type of feedback loop instead of a positive current feedback loop.

According to various embodiments, positive feedback LVR 102 may have feedback loop delay $T_{loop}$. In such embodiments, fast transient conditions may occur in a load coupled to LVR 100 that affect regulated output voltage VOUT significantly before positive feedback LVR 102 is able to respond. In various embodiments, transient feedback circuit 104 monitors regulated output voltage VOUT and provides a fast response to positive feedback LVR 102. Specifically, transient feedback circuit 104 may have transient feedback delay $T_{transFB}$ that is less than (or much less than) feedback loop delay $T_{loop}$, i.e., $T_{transFB}<T_{loop}$ or $T_{transFB}<<T_{loop}$. In such embodiments, transient feedback circuit 104 may enable positive feedback LVR 102 to respond more quickly to fast transient conditions and improve output voltage regulation for regulated output voltage VOUT.

In particular embodiments, transient feedback circuit 104 includes a current injector or a current sink coupled to the positive current feedback loop in positive feedback LVR 102. The current injector or the current sink quickly injects or sinks current into or from, respectively, the positive current feedback loop during transient conditions. Transient feedback circuit 104 may include a differentiator or differentiators coupled to an output node supplied by regulated output voltage VOUT in order to control the current injector or current sink based on regulated output voltage VOUT. Specifically, transient feedback circuit 104 may include a capacitive differentiator or differentiators with a capacitance ranging from 1 to 5 picofarads (pF).

It is possible that changes of current levels within positive feedback LVR 102, such as changes within the positive current feedback loop for example, may produces errors in regulated output voltage VOUT. Thus, various embodiments include current subtractor 106 configured to stabilize current flowing within positive feedback LVR 102. In specific embodiments, current subtractor 106 may sink current flowing into a reference node in order to stabilize the reference node and decrease the impedance of the reference node. In such embodiments, a voltage at the reference node may be generated based on reference voltage VREF.

According to various embodiments, LVR 100 includes transient feedback circuit 104 in order to improve transient response time and also includes current subtractor 106 in order to further improve stability of regulated output voltage VOUT. In such embodiments, LVR 100 is formed as an integrated system on a single microfabricated die, i.e., on-chip, and does not include an external capacitor coupled to the output node supplied with regulated output voltage VOUT, i.e., off-chip. LVR 100 may include internal, on-chip, capacitors integrated on the single microfabricated die. In other alternative embodiments, LVR 100 may include only one of either transient feedback circuit 104 or current subtractor 106.

Figure 2:
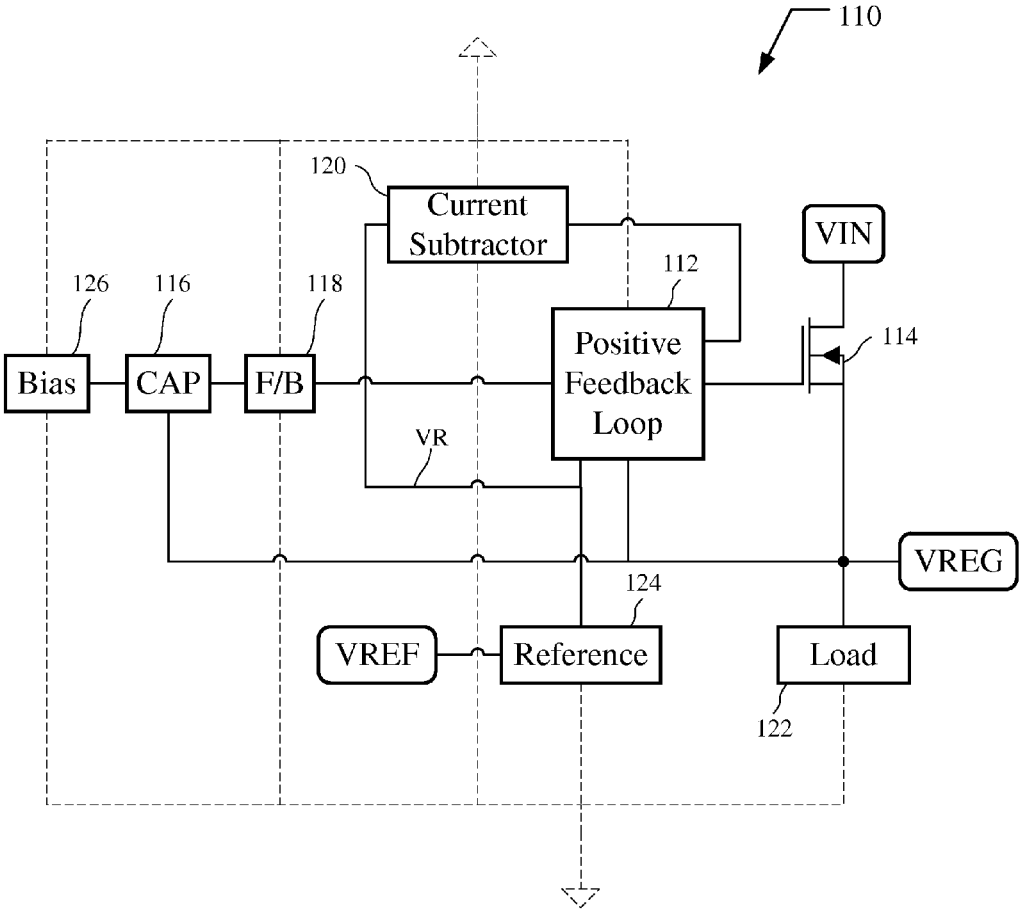
FIG. 2 illustrates a functional block diagram of an embodiment linear voltage regulator.

FIG. 2 illustrates a functional block diagram of an embodiment linear voltage regulator (LVR) 110 including positive feedback loop 112, pass element 114, capacitive differentiator 116, current feedback circuit 118, current subtractor 120, load 122, reference generator 124, and bias circuit 126. According to various embodiments, positive feedback loop 112 is coupled to pass element 114 and the output node with regulated output voltage VOUT. Pass element 114 is connected between input voltage VIN and load 122 and is controlled to adjust a resistance based on the current drawn by load 122 in order to maintain regulated output voltage VOUT as a stable supply to load 122. In various embodiments, positive feedback loop 112 controls pass element 114 in order to supply more current or supply less current, to keep regulated output voltage VOUT stable, when current drawn by load 122 increases or decreases, respectively. Particularly, positive feedback loop 112 may inject more current into a control terminal of pass element 114, e.g., a gate of a transistor, or directly into the node with regulated output voltage VOUT that is coupled to load 122.

In various embodiments, input voltage VIN is supplied to pass element 114 and used to generate regulated output voltage VOUT. In such embodiments, input voltage VIN is a higher voltage than regulated output voltage VOUT. In specific embodiments, input voltage VIN is a dropout voltage VDO above regulated output voltage VOUT. For example, dropout voltage VDO may range from about 0.5 to 3 volts, depending on the type of components used to implement pass element 114. In particular embodiments, pass element 114 is an n-type MOSFET. In alternative embodiments, pass element 114 may be implemented as other types of transistors or variable resistance devices in various configurations.

According to various embodiments, positive feedback loop 112 generates regulated output voltage VOUT based on a voltage at virtual reference node VR supplied by reference generator 124, which is generated based on reference voltage VREF. As similarly described hereinabove, current subtractor 120 may remove more or less current from virtual reference node VR in order to decrease the impedance and stabilize voltage variations at virtual reference node VR, which in turn stabilizes regulated output voltage VOUT.

As similarly described hereinabove in reference to transient feedback circuit 104 and positive feedback LVR 102 in FIG. 1, positive feedback loop 112 may have a feedback loop delay $T_{loop}$. In order to improve the transient response, capacitive differentiator 116 and current feedback circuit 118 are coupled between the output node with regulated output voltage VOUT and an input node of positive feedback loop 112. Capacitive differentiator 116 adjusts a control signal that controls current feedback circuit 118 to sink or source current from or into the positive current feedback loop in positive feedback loop 112. In such embodiments, capacitive differentiator 116 and current feedback circuit 118 have a transient feedback delay $T_{transFB}$ that is less than (or much less than) feedback loop delay $T_{loop}$, i.e., $T_{transFB}<T_{loop}$ or $T_{transFB}<<T_{loop}$, as described hereinabove in reference to FIG. 1. In various embodiments, bias circuit 126 may supply a bias signal to capacitive differentiator 116 and current feedback circuit 118.

According to various embodiments, some or all of the elements included in LVR 110 may be coupled to a positive voltage supply line, such as VDD, or a negative or low voltage supply line, such as GND or VSS, as shown by the dashed lines and dashed positive and negative supplies. In various embodiments, load 122 may be any type of load. In particular embodiments, load 122 is a DC load configured to operate with a stable voltage supplied by regulated output voltage VOUT. In such embodiments, load 122 may draw variable current loads and cause LVR 110 to adjust current supplied and maintain regulated output voltage VOUT.

According to various embodiments, the output node supplied by regulated output voltage VOUT and configured to be coupled to load 122 has a small capacitance. In particular embodiments, the total capacitance of the output node is less than 5 μF. In a more specific embodiment, the total capacitance of the output node is less than 100 pF. In specific embodiments, the capacitance of capacitive differentiator 116 ranges from 1 to 5 pF. In such embodiments, LVR 100 is implemented as an integrated device without an eternal or off-chip capacitor attached to the output node. In such embodiments, load 122 may be implemented on-chip or off-chip.

Figure 3:
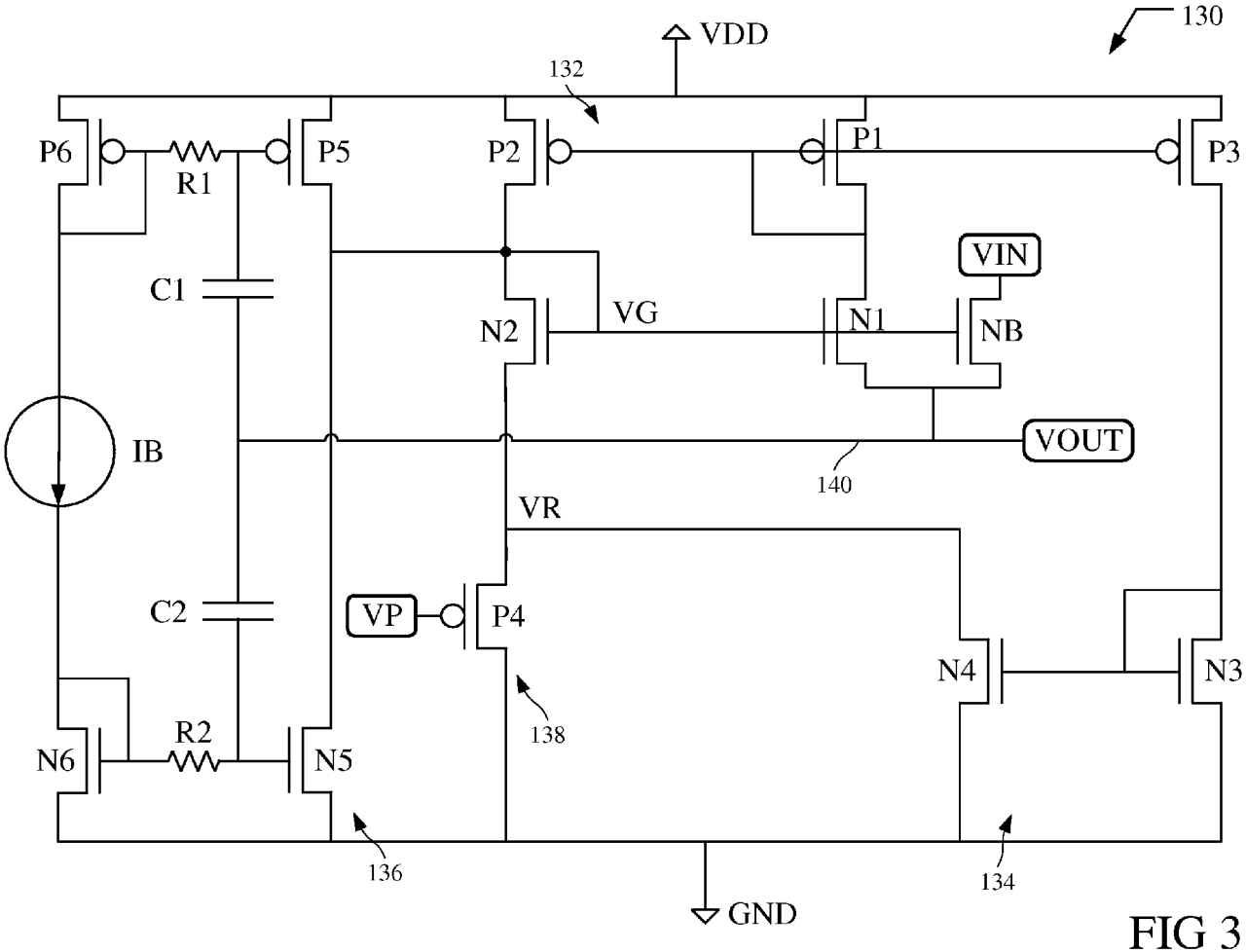
FIG. 3 illustrates a schematic diagram of an embodiment linear voltage regulator.

FIG. 3 illustrates a schematic diagram of an embodiment linear voltage regulator (LVR) 130 including pass transistor NB, current conveyor 132, current subtractor 134, transient enhancement circuit 136, and reference circuit 138. According to various embodiments, current conveyor 132 operates as a positive current feedback loop coupled to output node 140, which supplies regulated output voltage VOUT. The control terminal of pass transistor NB is adjusted to regulate the resistance and generate regulated output voltage VOUT from input voltage VIN. Pass transistor NB is an n-type transistor. In alternative embodiments, pass transistor NB may be another type of transistor. In various embodiments, current conveyor 132 operates to inject more or less current into the control terminal of pass transistor NB, raising or lowering the control voltage, i.e., gate voltage VG, based on current drawn through output node 140, such as by a load supplied with regulated output voltage VOUT. Current conveyor 132 includes n-type transistor N1, p-type transistor P1, p-type transistor P2, and n-type transistor N2.

According to various embodiments, when current flowing out of output node 140, such as to a load, increases, current flowing through n-type transistor N1 also increases while gate voltage VG supplied to the control terminal of pass transistor NB does not initially change. The current increase in n-type transistor N1 also occurs in p-type transistor P1 because of the series connection between the transistors. P-type transistor P1 and p-type transistor P2 are connected as a current mirror. Thus, the current increase in n-type transistor N1 is conveyed or mirrored to p-type transistor P2, which causes the current flowing in series connected n-type transistor N2 to increase as well. The increase in current flowing through n-type transistor N2 causes gate voltage VG, which is supplied to both n-type transistor N1 and pass transistor NB, to increase because of the diode type connection between the gate and top conduction terminal of n-type transistor N2. Thus, pass transistor NB is controlled to increase the current supplied to output node 140 when the current flowing through output node 140 increases, such as when a load current increases for a load supplied with regulated output voltage VOUT. Increasing the current flowing through pass transistor NB as described above counteracts potential voltage drops at output node 140 in response to increased load currents and helps to maintain regulated output voltage VOUT with reduced variation.

In a similar manner as described above for the opposite polarity, when current flowing out of output node 140 decreases, current flowing through n-type transistor N1 also decreases while gate voltage VG supplied to the control terminal of pass transistor NB does not initially change. The current decrease in n-type transistor N1 also occurs in p-type transistor P1 because of the series connection between the transistors. The current decreases in n-type transistor N1 is conveyed or mirrored to p-type transistor P2 through p-type transistor P1, which causes the current flowing in n-type transistor N2 to decrease as well. The decrease in current flowing through n-type transistor N2 causes gate voltage VG to decrease because of the diode type connection between the gate and top conduction terminal of n-type transistor N2. Thus, pass transistor NB is controlled to decrease the current supplied to output node 140 when the current flowing through output node 140 decreases, such as when a load current decreases for a load supplied with regulated output voltage VOUT. Decreasing the current flowing through pass transistor NB as described above counteracts potential voltage increases at output node 140 in response to decreased load currents and helps to maintain regulated output voltage VOUT with reduced variation.

In various embodiments, current conveyor 132 operates as a positive feedback loop. In particular embodiments, current conveyor 132 includes transistors N1, P1, P2, and N2 sized in order to provide a loop gain that is less than 1.

As similarly described hereinabove in reference to positive feedback LVR 102 and positive feedback loop 112, current conveyor 132 may operate as a current feedback loop with a feedback loop delay $T_{loop}$. In some embodiments, it may be advantageous to speed up the transient response of LVR 130. Thus, transient enhancement circuit 136 is coupled to output node 140 and to the feedback node with gate voltage VG in current conveyor 132. In various embodiments, transient enhancement circuit 136 sinks or sources current into the current conveyor 132 and raises or lower gate voltage VG. In such embodiments, transient enhancement circuit has a transient feedback delay $T_{transFB}$ that is less than (or much less than) feedback loop delay $T_{loop}$, i.e., $T_{transFB}<T_{loop}$ or $T_{transFB}<<T_{loop}$, as described hereinabove in reference to FIGS. 1 and 2.

According to various embodiments, transient enhancement circuit 136 includes p-type transistor P5, n-type transistor N5, feedback capacitor C1 and feedback capacitor C2. Further, transient enhancement circuit 136 may include elements for biasing p-type transistor P5 and n-type transistor N5. In some example embodiments, as shown, transient enhancement circuit 136 includes p-type transistor P6, biasing current source IB, n-type transistor N6, bias resistor R1, and bias resistor R2 for biasing p-type transistor P5 and n-type transistor N5. In some embodiments, other bias circuit may be provided for example. Resistor R1 and resistor R2 may be optionally removed in some embodiments. In some embodiments, transient enhancement circuit 136 may include only the lower portion with feedback capacitor C2 and n-type transistor N5, and the accompanying bias circuit, or only the upper portion with feedback capacitor C1 and p-type transistor P5, and the accompanying bias circuit.

In various embodiments, feedback capacitor C1 and feedback capacitor C2 may operate as differentiators that adjust control voltages supplied to p-type transistor P5 and n-type transistor N5, respectively, based on changes in regulated output voltage VOUT. Specifically, during transient conditions in which regulated output voltage VOUT begins to decrease, such as when the current drawn by the load increases quickly, the voltage supplied through feedback capacitor C1 to the control terminal of p-type transistor P5 begins to decrease, increasing the current flowing through p-type transistor P5, and the voltage supplied through feedback capacitor C2 to the control terminal of n-type transistor N5 begins to decrease, decreasing the current flowing through n-type transistor N5. Thus, when regulated output voltage VOUT decreases, extra current is injected into the feedback node with gate voltage VG because current flowing through p-type transistor P5 increases and current flowing through n-type transistor N5 decreases. This causes gate voltage VG to increase, providing more current to output node 140 from pass transistor NB and increasing regulated output voltage VOUT contrary to the initial voltage decrease.

As similarly described above for the opposite polarity, during transient conditions in which regulated output voltage VOUT begins to increase, such as when the current drawn by the load decreases quickly, the voltage supplied through feedback capacitor C1 to the control terminal of p-type transistor P5 begins to increase, decreasing the current flowing through p-type transistor P5, and the voltage supplied through feedback capacitor C2 to the control terminal of n-type transistor N5 begins to increase, increasing the current flowing through n-type transistor N5. Thus, when regulated output voltage VOUT increases, current is removed from the feedback node with gate voltage VG because current flowing through p-type transistor P5 decreases and current flowing through n-type transistor N5 increases. This causes gate voltage VG to decrease, providing less current to output node 140 from pass transistor NB and decreasing regulated output voltage VOUT contrary to the initial voltage increase.

In various such embodiments, transient enhancement circuit 136 operates with transient feedback delay $T_{transFB}$ to more quickly correct variations, increasing or decreasing, in regulated output voltage VOUT than current conveyor 132 with feedback loop delay $T_{loop}$. Transient enhancement circuit 136 injects current into or removes current from the current feedback loop of current conveyor 132, which increases or decreases gate voltage VG, based on transient variations in regulated output voltage VOUT. In some embodiments, transient feedback delay $T_{transFB}$ of transient enhancement circuit 136 is less than or equal to half of feedback loop delay $T_{loop}$ of current conveyor 132. In particular embodiments, transient feedback delay $T_{transFB}$ of transient enhancement circuit 136 is less than or equal to 1/10 of feedback loop delay $T_{loop}$ of current conveyor 132.

As similarly described hereinabove in reference to current subtractor 106 and current subtractor 120 in FIGS. 1 and 2, respectively, current subtractor 134 may remove more or less current from virtual reference node VR in order to decrease the impedance and stabilize voltage variations at virtual reference node VR, which in turn stabilizes regulated output voltage VOUT. N-type transistor N2 is supplied with a voltage at virtual reference node VR from reference circuit 138.

In various embodiments, reference circuit 138 includes p-type transistor P4, which is controlled by bias voltage VP. In various embodiments, bias voltage VP may be generated by another bias circuit or element that is included on a same integrated circuit as LVR 130 or may be provided from an off-chip component. In such embodiments, bias voltage VP may be approximately constant, which causes the current flowing through p-type transistor P4 to remain constant unless the voltage at virtual reference node VR increases. Changes in the voltage at virtual reference node VR produce changes in regulated output voltage VOUT because of the coupling of control terminals between n-type transistor N2, n-type transistor N1, and pass transistor NB. Thus, variations in the voltage at virtual reference node VR may produce variations in regulated output voltage VOUT. In various embodiments, the current flowing into virtual reference node VR may increase or decrease because current conveyor 132, transient enhancement circuit 136, or both increases or decreases the current flowing through n-type transistor N2, which is series connected with p-type transistor P4. In such embodiments, in order to prevent the voltage at virtual reference node VR from fluctuating, current subtractor 134 sinks more or less current as the current flowing through n-type transistor N2 increases or decreases, respectively.

According to various embodiments, current subtractor 134 includes n-type transistor N4, n-type transistor N3, and p-type transistor P3. N-type transistor N4 sinks current flowing into virtual reference node VR. As the current flowing into virtual reference node VR increases n-type transistor N4 sinks more current, and as the current flowing into virtual reference node VR decreases n-type transistor N4 sinks less current. The current flowing through n-type transistor N4 is controlled based on mirroring the current flowing in n-type transistor N3. N-type transistor N3 is diode connected, and connected as a current mirror with n-type transistor N4, in series with p-type transistor P3, which has a control terminal coupled to the control terminals of p-type transistor P1 and P-type transistor P2. Thus, increases in current flowing through p-type transistor P1 and p-type transistor P2, which are connected as a current mirror, will increase the current flowing through p-type transistor P3 because the three p-type transistors have control terminals that are coupled together. In such embodiments, the operation of current conveyor 132 or transient enhancement circuit 136 will increase or decrease the current flowing through p-type transistor P1 and p-type transistor P2, which will in turn increase or decrease the current flowing through p-type transistor P3, which will cause the increase or decrease in current to be mirrored in n-type transistor N4 through the current mirror connection to n-type transistor N3. Thus, n-type transistor N4 is controlled based on increased or decreased currents flowing through n-type transistor N2 to sink more or less current, respectively.

According to various embodiments, the operation of n-type transistor N4 decreases the impedance of virtual reference node VR and reduces voltage variations at virtual reference node VR, which in turn reduces voltage variations in regulated output voltage VOUT. In particular embodiments, it may be advantageous that n-type transistor N2 and n-type transistor N4 have matching conductivity types. In such embodiments, differences in device variation produced during fabrication between n-type transistor N2 and n-type transistor N4 may be reduced by using matching transistor types including, e.g., transistor conductivity type and size.

In various embodiments, current conveyor 132 is an embodiment implementation of positive feedback loop 112 or positive feedback LVR 102. Similarly, current subtractor 134 is an embodiment implementation of current subtractor 106 in FIG. 1 or current subtractor 120 in FIG. 2. Transient enhancement circuit 136 is an embodiment implementation of transient feedback circuit 104 in FIG. 1 or capacitive differentiator 116 and current feedback circuit 118 in FIG. 2.

As shown, each transistor in LVR 130 is depicted as either n-type or p-type. In alternative embodiments, any of the embodiment transistors may be implemented using the opposite conductivity type in order to implement circuits with different polarity configurations as will be readily appreciated by one having skill in the art. Each transistor included in LVR 130 may be a field effect transistor (FET), such as a MOSFET, in various embodiments. Other transistor technologies may be used in other embodiments, as will be readily appreciated by one of skill in the art.

According to various embodiments, LVR 130 is supplied with positive supply line VDD and low supply line GND. In various embodiments, positive supply line VDD and low supply line GND may range in voltage depending on the technology used and the desired level of regulated output voltage VOUT. For example, the voltage difference between positive supply line VDD and low supply line GND may be between 1.8 and 5 V. The voltage may also be greater than 5 V in various embodiments. In various embodiments, input voltage VIN and positive supply line VDD may be the same voltage or different voltages.

Figure 4:
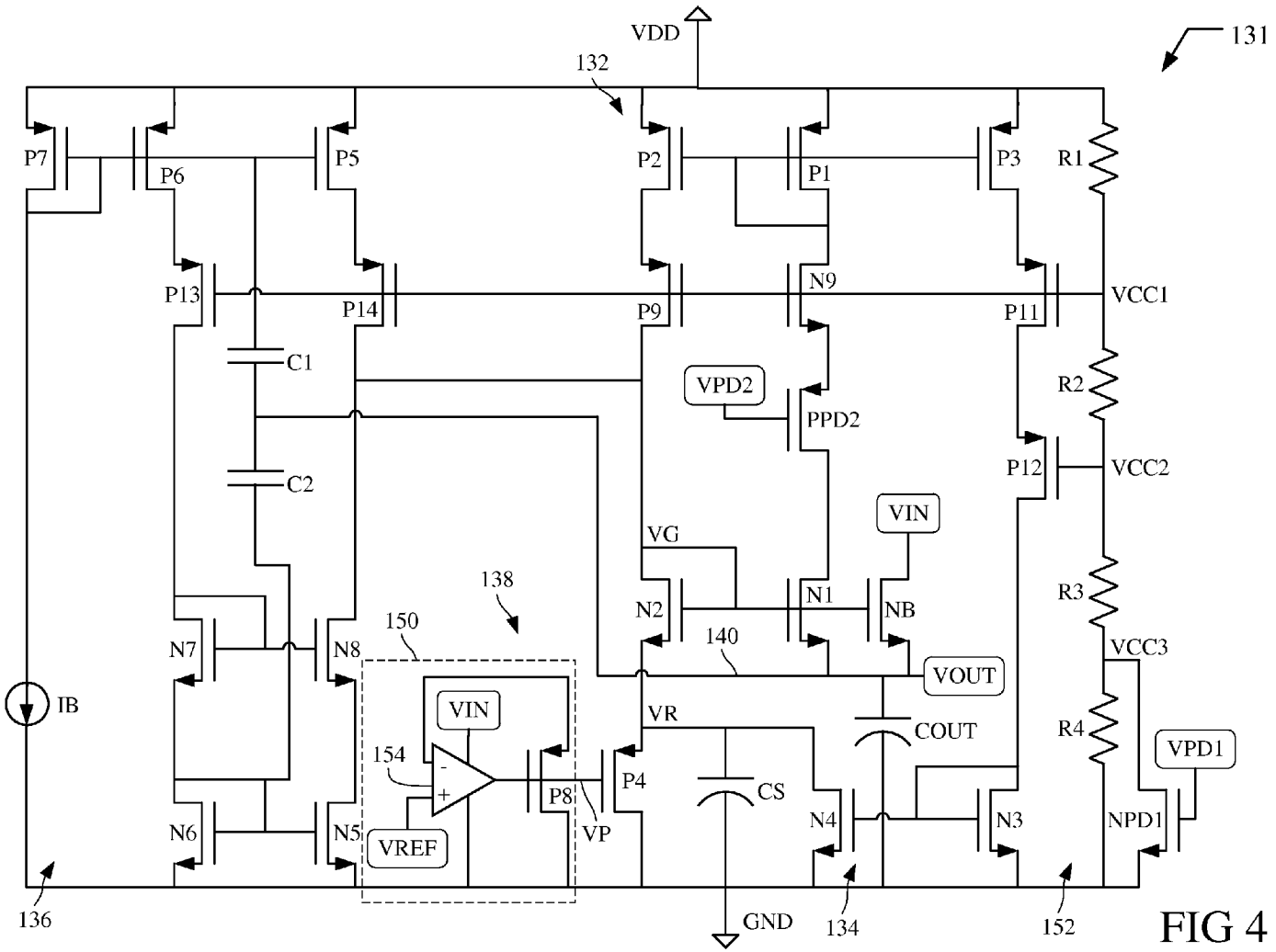
FIG. 4 illustrates a schematic diagram of another embodiment linear voltage regulator.

FIG. 4 illustrates a schematic diagram of another embodiment linear voltage regulator (LVR) 131 including pass transistor NB, current conveyor 132, current subtractor 134, transient enhancement circuit 136, reference circuit 138, and resistive divider 152. According to various embodiments, LVR 131 is one particular implementation of LVR 130 described hereinabove in reference to FIG. 3. Description of similarly numbered elements applies to matching elements in LVR 131 in FIG. 4, where various additional embodiment features have been included in LVR 131.

Pass transistor NB is coupled to input voltage VIN and generates regulated output voltage VOUT at output node 140. In such embodiments, output capacitor COUT is coupled to output node 140. Output capacitor COUT may be a parasitic capacitance or an integrated capacitor formed on a same integrated circuit with LVR 131, i.e., an on-chip capacitor. In particular embodiments, output capacitor COUT is not an off-chip capacitor. According to some embodiments, output capacitor COUT has a capacitance value of less than or equal to 100 pF.

In various embodiments, current conveyor 132 includes n-type transistor N1, p-type transistor P1, p-type transistor P2, and n-type transistor N2, and operates as similarly described hereinabove. In some embodiments, current conveyor 132 may also include n-type transistor N9, p-type transistor P9, and p-type transistor PPD2. In such embodiments, n-type transistor N9 and p-type transistor P9 are included for overstress prevention. Particular transistor sizes and technologies may be rated for a given voltage. Including n-type transistor N9 and p-type transistor P9 allows transistors for a lower voltage to be used in cascade for a higher voltage supply. A person having ordinary skill in the art will recognize that overstress prevention may be removed or added within the scope of various embodiments described herein. Optional p-type transistor PPD2 may be controlled by power down voltage VPD2 for power down functionality. In various embodiments, p-type transistor PPD2 may be omitted.

In various embodiments, current subtractor includes n-type transistor N4, n-type transistor N3, and p-type transistor P3, and operates as similarly described hereinabove. Current subtractor 134 may also include optional p-type transistor P11 and optional p-type transistor P12 for overstress prevention.

In some embodiments, reference circuit 138 includes p-type transistor P4 and bias generator 150 configured to supply bias voltage VP to p-type transistor P4. In such embodiments, bias generator 150 includes p-type transistor P8 and differential amplifier 154 with a negative input coupled to the source of p-type transistor P8 and a positive input coupled to reference voltage VREF. Differential amplifier 154 is supplied with input voltage VIN and low supply line GND in some embodiments. In some embodiments, the source of p-type transistor P8 is coupled to the negative input of differential amplifier 154 such that, during operation, the source of p-type transistor P8 is forced to be at a voltage that is about the same as reference voltage VREF. In such embodiments, p-type transistor P4 is driven with the same drive signal as p-type transistor P8 such that virtual reference node VR is also set to have a voltage that is about the same as reference voltage VREF. In other embodiments, differential amplifier 154 may be supplied with positive supply line VDD or another voltage. In still further embodiments, bias generator 150 may be implemented with various other bias generating circuits.

According to various embodiments, virtual reference node VR, which is coupled to reference circuit 138 and current subtractor 134, is coupled to capacitor CS. Capacitor CS may be a parasitic capacitance or an integrated capacitor formed on a same integrated circuit with LVR 131, i.e., an on-chip capacitor. In particular embodiments, capacitor CS is not an off-chip capacitor. According to some embodiments, capacitor CS has a capacitance value that ranges from 10 pF to 100 pF.

According to various embodiments, transient enhancement circuit 136 includes p-type transistor P5, n-type transistor N5, feedback capacitor C1, and feedback capacitor C2, and operates as similarly described hereinabove. In some embodiments, transient enhancement circuit 136 includes a bias circuit including p-type transistor P6, p-type transistor P7, n-type transistor N6, and biasing current source IB. The bias circuit maintains p-type transistor P5 and n-type transistor N5 biased while feedback capacitor C1 and feedback capacitor C2 adjust control voltages supplied to control terminals of p-type transistor P5 and n-type transistor N5 in order to increase or decrease current flowing through p-type transistor P5 and n-type transistor N5. In particular embodiments, transient enhancement circuit 136 may also include optional overstress prevention transistors including p-type transistor P13, p-type transistor P14, n-type transistor N7, and n-type transistor N8, as similarly described in reference to p-type transistor P9 and n-type transistor N9.

In various embodiments, resistive divider 152 includes resistor R1, resistor R2, resistor R3, resistor R4, and bypass transistor NPD1. Resistive divider 152 is coupled between high supply voltage line VDD and low supply line GND and divides the supply line voltage across resistors R1, R2, R3, and R4 in order to generate voltage supply levels VCC1, VCC2, and VCC3. When bypass transistor NPD1, an n-type transistor, is conducting, resistor R4 is short circuited and functionally removed from resistive divider 152 so that the supply line voltage is divided across only resistors R1, R2, and R3. The supply line voltage is divided across all of resistors R1, R2, R3, and R4 when bypass transistor NPD1 is not conducting. In other embodiments, bypass transistor NPD1 may be driven by bias voltage VPD1 in order to vary the resistance of bypass transistor NPD1 and implement a variable resistance for resistive divider 152. In various embodiments, power down voltage VPD1 and power down voltage VPD2 provide optional power down functions and may be omitted along with p-type transistor PPD2 and n-type transistor NPD1. In various embodiments, voltage supply level VCC1 is supplied to bias optional transistors P11, N9, P9, P13, and P14, which are used for overstress prevention. Voltage supply level VCC2 is supplied to bias p-type transistor P12.

Figure 5:
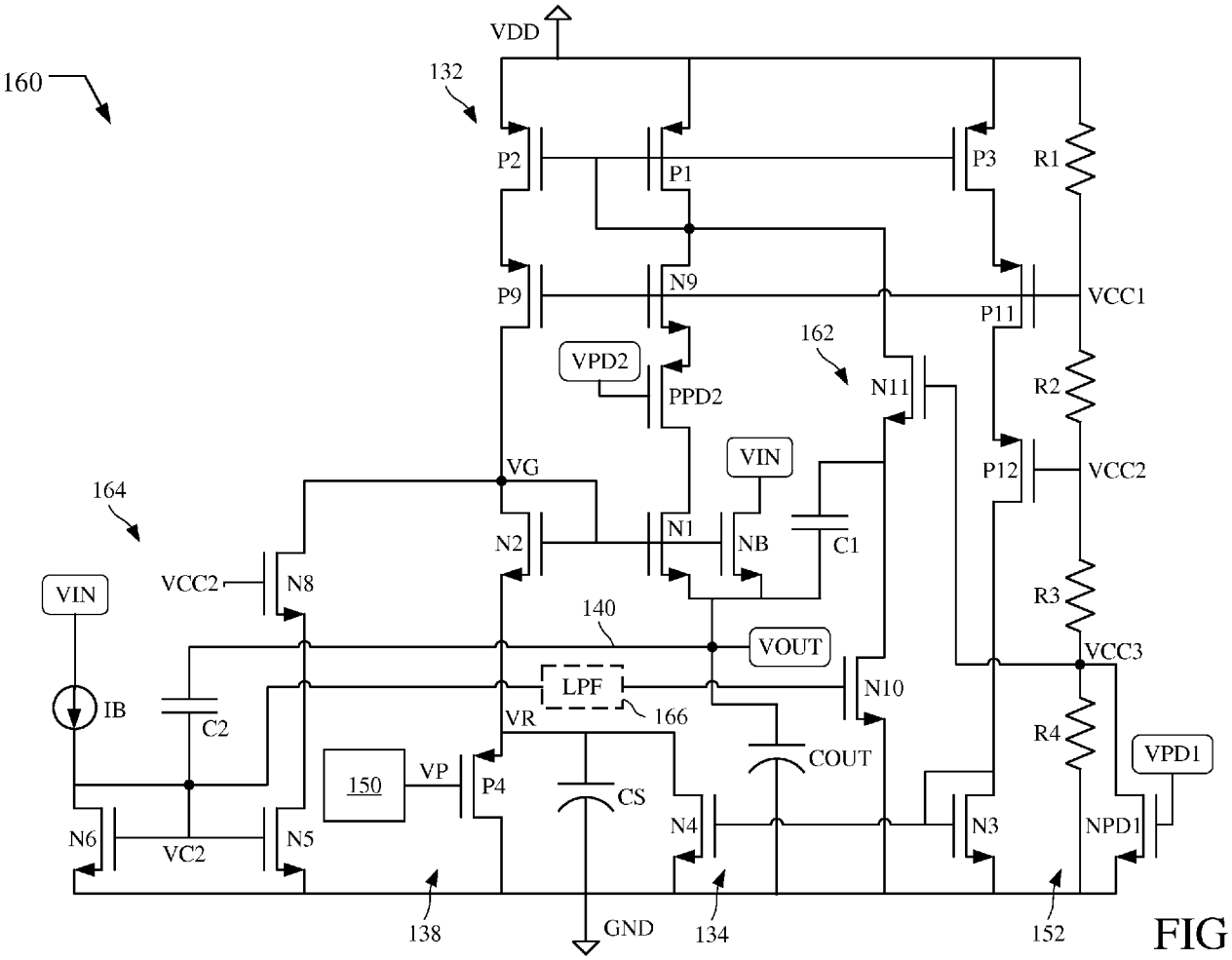
FIG. 5 illustrates a schematic diagram of a further embodiment linear voltage regulator.

FIG. 5 illustrates a schematic diagram of a further embodiment linear voltage regulator (LVR) 160 including pass transistor NB, current conveyor 132, current subtractor 134, reference circuit 138, resistive divider 152, transient enhancement circuit 162, and transient enhancement circuit 164. According to various embodiments, LVR 161 is similar to LVR 130 and LVR 131 described hereinabove in reference to FIGS. 3 and 4. Description of similarly numbered elements hereinabove applies to matching elements in LVR 160 in FIG. 5 and will not be repeated in the interest of brevity. In such embodiments, transient enhancement circuit 136 described hereinabove in reference to LVR 130 and LVR 131 in FIGS. 3 and 4 is replaced in LVR 160 with transient enhancement circuit 162 and transient enhancement circuit 164.

According to various embodiments, transient enhancement circuit 162 and transient enhancement circuit 164 operate in a similar manner as described in reference to transient enhancement circuit 136. In various embodiments, transient enhancement circuit 162 includes feedback capacitor C1, n-type transistor N11, and n-type transistor N10. In various embodiments, transient enhancement circuit 164 includes feedback capacitor C2, n-type transistor N5, n-type transistor N8, n-type transistor N6, and biasing current source IB. N-type transistor N10 and voltage supply level VCC3 coupled to n-type transistor N11 are configured to bias transient enhancement circuit 162. N-type transistor N8, biasing current source IB, and n-type transistor N6 are configured to bias transient circuit 164. Further, in some embodiments, the control terminal of n-type transistor N10 is coupled to the output of biasing current source IB in order to bias n-type transistor N10. In particular embodiments, low pass filter (LPF) 166 couples the control terminal of n-type transistor N10 to the output of biasing current source IB.

In some embodiments, transient enhancement circuit 164 operates to quickly counteract decreases in regulated output voltage VOUT. When current flowing through output node 140, such as to a load supplied by regulated output voltage VOUT, increases, regulated output voltage VOUT begins to decrease initially. As soon as regulated output voltage VOUT begins to decrease, the voltage at the control terminal of n-type transistor N5 is controlled through feedback capacitor C2 to decrease, which reduces the current flowing through n-type transistor N5 and n-type transistor N8. Because the current flowing out of the feedback node with gate voltage VG is reduced, gate voltage VG increases, causing pass transistor NB to supply more current to output node 140 and increase regulated output voltage VOUT contrary to the initial voltage decrease.

In some embodiments, transient enhancement circuit 164 operates to quickly counteract increases in regulated output voltage VOUT. In a similar manner as described above for the opposite polarity, when current flowing out of output node 140 decreases, regulated output voltage VOUT begins to increase initially. As soon as regulated output voltage VOUT begins to increase, the voltage at the control terminal of n-type transistor N5 is controlled through feedback capacitor C2 to increase, which increases the current flowing through n-type transistor N5 and n-type transistor N8. Because the current flowing out of the feedback node with gate voltage VG is increased, gate voltage VG decreases, causing pass transistor NB to supply less current to output node 140 and decrease regulated output voltage VOUT contrary to the initial voltage increase.

In some embodiments, transient enhancement circuit 162 operates to quickly counteract decreases in regulated output voltage VOUT. When current flowing through output node 140 increases, regulated output voltage VOUT begins to decrease initially. As soon as regulated output voltage VOUT begins to decrease, the voltage at the source terminal of n-type transistor N11 is controlled through feedback capacitor C1 to decrease, which increases the current flowing through n-type transistor N11 and increases the current flowing out of the control terminals of p-type transistor P1 and p-type transistor P2. Because the current flowing out of the control terminals of p-type transistor P2 is increased, the voltage at the control terminal decreases, causing p-type transistor P2 and p-type transistor P9 to conduct more current and increase gate voltage VG. As gate voltage VG increases, pass transistor NB supplies more current to output node 140 and increases regulated output voltage VOUT contrary to the initial voltage decrease.

In some embodiments, transient enhancement circuit 162 operates to quickly counteract increases in regulated output voltage VOUT. In a similar manner as described above for the opposite polarity, when current flowing through output node 140 decreases, regulated output voltage VOUT begins to increase initially. As soon as regulated output voltage VOUT begins to increase, the voltage at the source terminal of n-type transistor N11 is controlled through feedback capacitor C1 to increase, which decreases the current flowing through n-type transistor N11 and decreases the current flowing out of the control terminals of p-type transistor P1 and p-type transistor P2. Because the current flowing out of the control terminals of p-type transistor P2 is decreased, the voltage at the control terminal increases, causing p-type transistor P2 and p-type transistor P9 to conduct less current and decrease gate voltage VG. As gate voltage VG decreases, pass transistor NB supplies less current to output node 140 and decreases regulated output voltage VOUT contrary to the initial voltage increase.

In various embodiments, transient enhancement circuit 162 and transient enhancement circuit 164 may be used in combination. In other embodiments, only one of transient enhancement circuit 162 or transient enhancement circuit 164 is included. In a particular embodiment, only transient enhancement circuit 162 is included. In an alternative embodiment, only transient enhancement circuit 164 is included. According to some embodiments, LVR 160 may be less sensitive to noise in positive supply line VDD than LVR 130 or LVR 131.

Figure 6A:
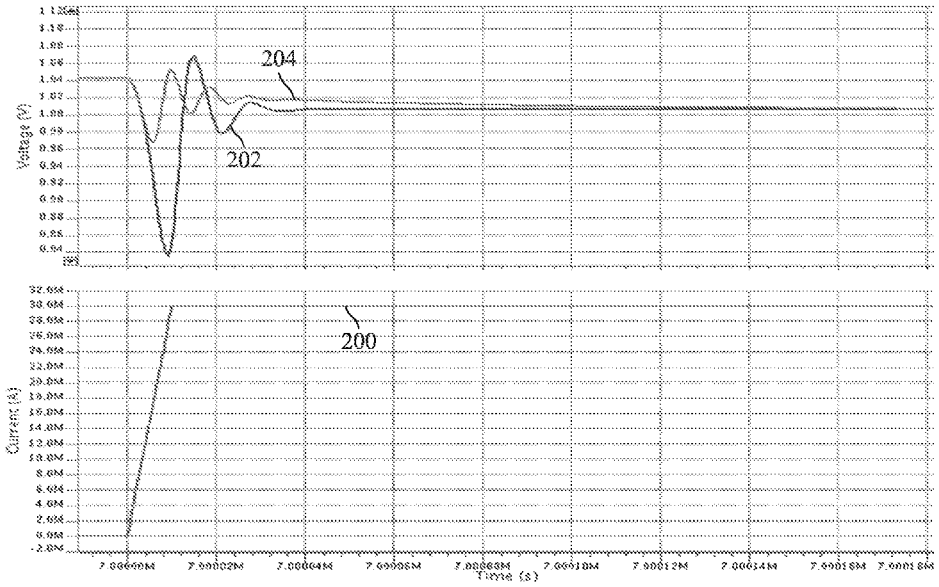
FIGS. 6A and 6B illustrate waveform diagrams of transient response plots.
Figure 6B:
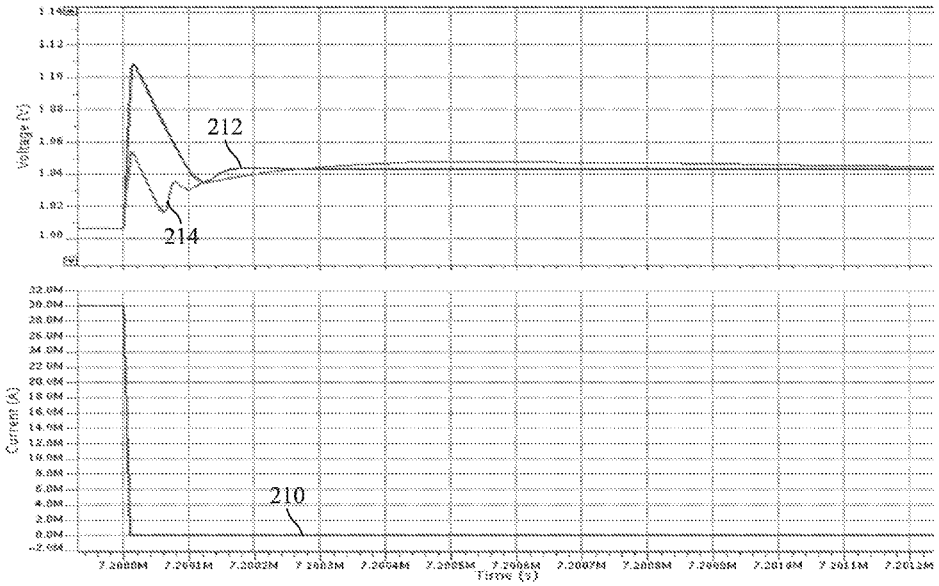

FIGS. 6A and 6B illustrate waveform diagrams of transient response plots comparing an LVR without a transient enhancement circuit to an LVR with a transient enhancement circuit. Current plot 200 in FIG. 6A depicts the current drawn from the output of an LVR ramping up, for example from 0 to 30 mA in 10 nanoseconds (ns). Output voltage 202 depicts the transient response of the regulated output voltage at the output of the LVR in response to the current increase without a transient enhancement circuit. Output voltage 204 depicts the transient response of the regulated output voltage at the output of the LVR in response to the current increase when a transient enhancement circuit is included, such as described hereinabove in reference to FIGS. 1, 2, 3, 4, and 5.

Similarly, current plot 210 in FIG. 6B depicts the current drawn from the output of an LVR dropping off, for example from 30 to 0 mA in 10 ns. Output voltage 212 depicts the transient response of the regulated output voltage at the output of the LVR in response to the current decrease without a transient enhancement circuit. Output voltage 214 depicts the transient response of the regulated output voltage at the output of the LVR in response to the current decrease when a transient enhancement circuit is included, such as described hereinabove in reference to FIGS. 1, 2, 3, 4, and 5. As shown in FIGS. 6A and 6B, the peak voltage at the output of a LVR during a fast transient may be reduced by 50% or more when a transient enhancement circuit is included in embodiment LVRs.

Various transient enhancement circuits described herein include feedback capacitor C1 and feedback capacitor C2. According to some embodiments, only one of feedback capacitor C1 and feedback capacitor C2, along with the relevant feedback transistor and bias circuitry, is included. Specifically, some embodiments only include feedback capacitor C1 and some embodiments only include feedback capacitor C2.

Figure 7A:
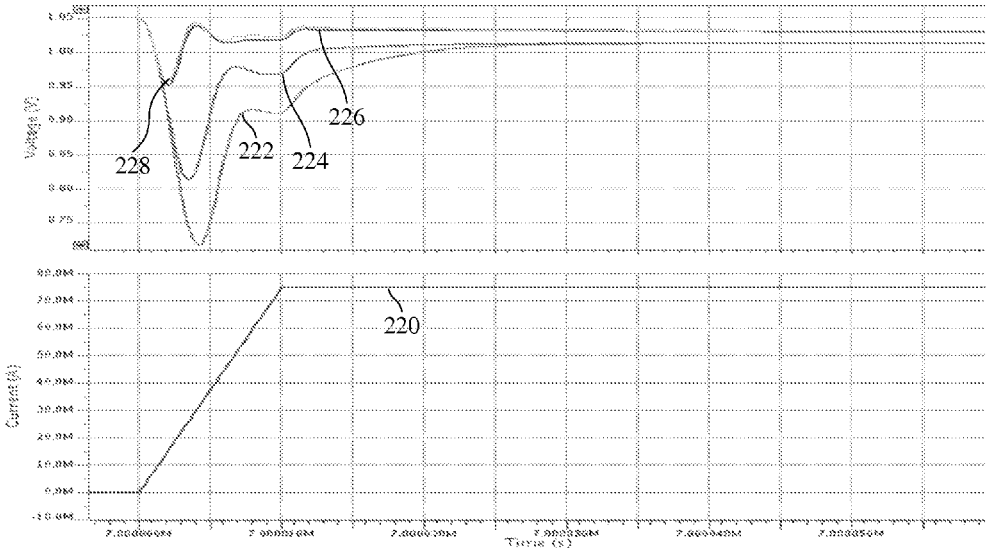
FIGS. 7A and 7B illustrate waveform diagrams of additional transient response plots.
Figure 7B:
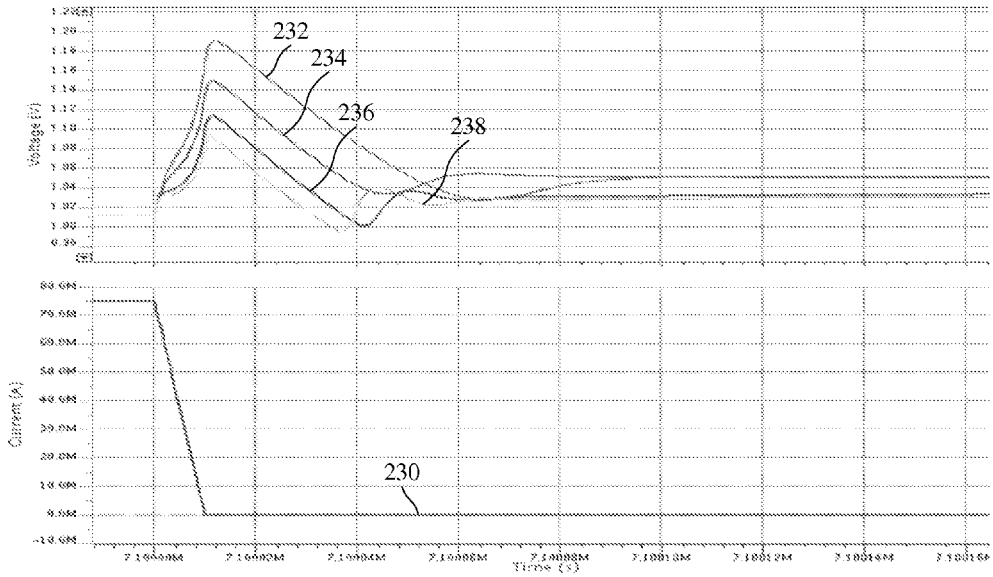

FIGS. 7A and 7B illustrate waveform diagrams of additional transient response plots comparing an LVR without a transient enhancement circuit to LVRs with transient enhancement circuit including different feedback capacitor configurations. Current plot 220 in FIG. 7A depicts the current drawn from the output of an LVR ramping up, for example from 0 to 75 mA in 10 ns. Output voltage 222 depicts the transient response of the regulated output voltage at the output of the LVR in response to the current increase without a transient enhancement circuit. Output voltage 224 depicts the transient response of the regulated output voltage at the output of the LVR in response to the current increase when a transient enhancement circuit is included, such as described hereinabove in reference to FIGS. 1, 2, 3, 4, and 5, where the transient enhancement circuit has feedback capacitor C2 only. Output voltage 226 depicts the transient response of the regulated output voltage at the output of the LVR in response to the current increase when a transient enhancement circuit is included where the transient enhancement circuit has feedback capacitor C1 only. Output voltage 228 depicts the transient response of the regulated output voltage at the output of the LVR in response to the current increase when a transient enhancement circuit is included where the transient enhancement circuit has both feedback capacitor C1 and feedback capacitor C2.

Similarly, current plot 230 in FIG. 7B depicts the current drawn from the output of an LVR dropping off, for example from 75 to 0 mA in 10 ns. Output voltage 232 depicts the transient response of the regulated output voltage at the output of the LVR in response to the current decrease without a transient enhancement circuit. Output voltage 234 depicts the transient response of the regulated output voltage at the output of the LVR in response to the current decrease when a transient enhancement circuit is included, such as described hereinabove in reference to FIGS. 1, 2, 3, 4, and 5, where the transient enhancement circuit has feedback capacitor C2 only. Output voltage 236 depicts the transient response of the regulated output voltage at the output of the LVR in response to the current decrease when a transient enhancement circuit is included where the transient enhancement circuit has feedback capacitor C1 only. Output voltage 238 depicts the transient response of the regulated output voltage at the output of the LVR in response to the current decrease when a transient enhancement circuit is included where the transient enhancement circuit has both feedback capacitor C1 and feedback capacitor C2. According to various embodiments, feedback capacitor C1 and feedback capacitor C2 may have capacitance values less than or equal to 10 pF. In particular embodiments, feedback capacitor C1 and feedback capacitor C2 have capacitance values less than or equal 5 pF.

Figure 8A:
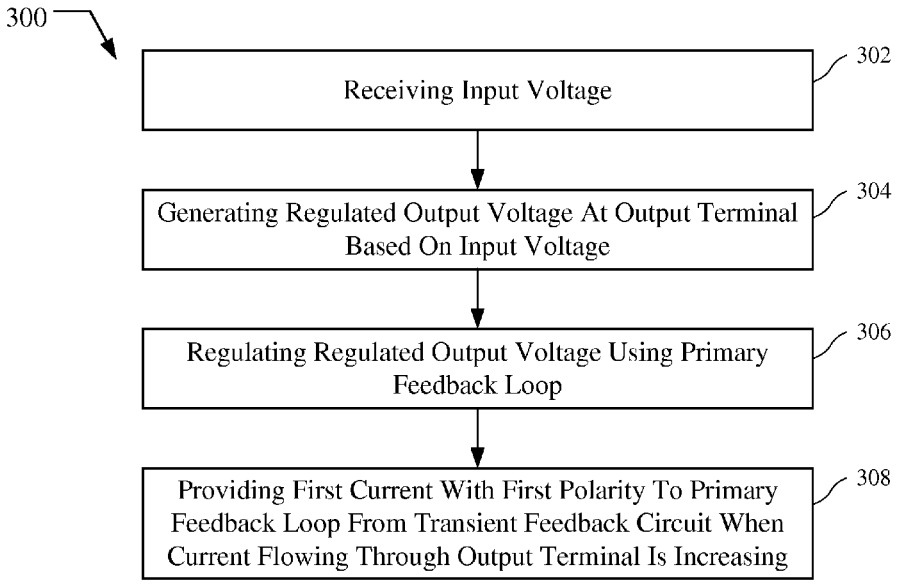
FIGS. 8A and 8B illustrate block diagrams of embodiment methods of generating a regulated output voltage.
Figure 8B:
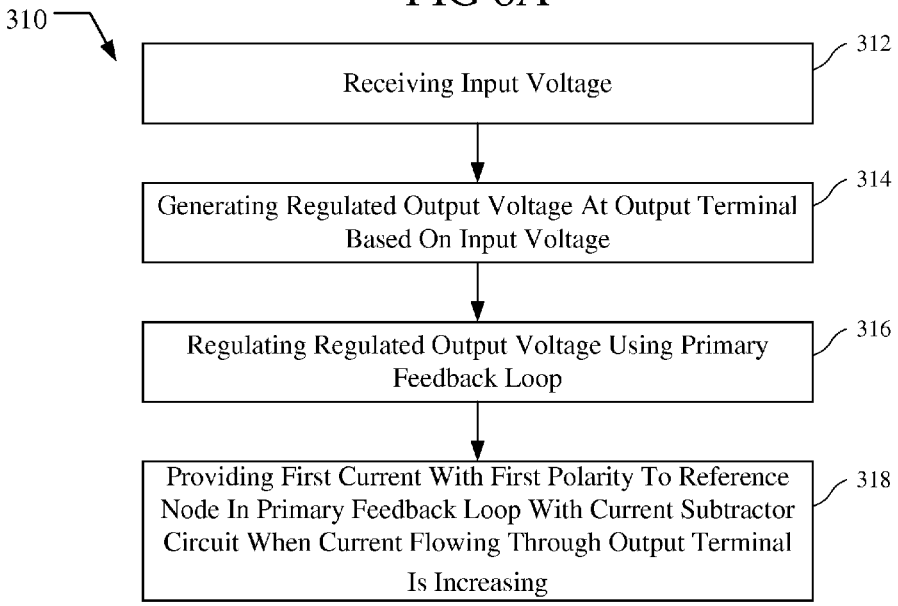

FIGS. 8A and 8B illustrate block diagrams of embodiment methods 300 and 310 of generating a regulated output voltage. FIG. 8A illustrates method 300 including steps 302-308. According to various embodiments, step 302 includes receiving an input voltage. For example, an LVR may receive an input voltage VIN. Step 304 includes generating the regulated output voltage at an output terminal based on the input voltage. In such embodiments, the output terminal may be coupled to a load that is to be supplied with the regulated output voltage. Step 306 includes regulating the regulated output voltage using a primary feedback loop. In some embodiments, the primary feedback loop is a positive feedback loop. Step 308 includes providing a first current with a first polarity to the primary feedback loop from a transient feedback circuit when current flowing through the output terminal is increasing. In such embodiments, the transient enhancement circuit may inject current into the primary feedback loop when current drawn from the output terminal increases, such as during transient conditions. In various embodiments, additional steps may be included in method 300. Steps 302-308 may be rearranged in alternative embodiments.

FIG. 8B illustrates method 310 including steps 312-318. According to various embodiments, step 312 includes receiving an input voltage. For example, an LVR may receive an input voltage VIN. Step 314 includes generating the regulated output voltage at an output terminal based on the input voltage. In such embodiments, the output terminal may be coupled to a load that is to be supplied with the regulated output voltage. Step 316 includes regulating the regulated output voltage using a primary feedback loop. In some embodiments, the primary feedback loop is a positive feedback loop. Step 318 includes providing a first current with a first polarity to a reference node in the primary feedback loop with a current subtractor circuit when current flowing through the output terminal is increasing. In such embodiments, the current subtractor may decrease the impedance at the reference node and reduce variation in voltage at the reference node. In various embodiments, additional steps may be included in method 310. Steps 312-318 may be rearranged in alternative embodiments.

According to various embodiments described herein in reference to the figures, the conductivity type, i.e., p-type or n-type, of various transistors may be switched in particular embodiments with different polarity configurations, as will be readily appreciated by those having skill in the art. Further, different embodiments may include various transistor types and technologies including MOSFETs, other types of FETs, bipolar junction transistors (BJTs), or other transistor device types.

According to an embodiment, a voltage regulator includes a linear voltage regulator (LVR) and a transient feedback circuit. The LVR a primary feedback loop, an input terminal configured to receive an input voltage, and an output terminal configured to output a regulated voltage. The transient feedback circuit is coupled to the output terminal and the primary feedback loop, and is configured to provide a first current with a first polarity to the primary feedback loop when current flowing through the output terminal is increasing. Other embodiments include corresponding systems and apparatus, each configured to perform corresponding embodiment methods.

Implementations may include one or more of the following features. In various embodiments, the voltage regulator further includes a current subtractor circuit coupled to the primary feedback loop and configured to provide a second current with a second polarity to a reference node in the primary feedback loop when current flowing through the output terminal is increasing. In such embodiments, the second polarity is opposite the first polarity. In some embodiments, the current subtractor circuit includes a current mirror having a first branch and a second branch, where the first branch is coupled to the reference node. The current subtractor also includes control transistor coupled to the second branch, where a control terminal of the control transistor is coupled to a control node of the primary feedback loop.

In various embodiments, the transient feedback circuit has a faster response time than the primary feedback loop. The transient feedback circuit may include a first feedback capacitor coupled to the output terminal and a second feedback capacitor coupled to the output terminal. In such embodiments, the first feedback capacitor and the second feedback capacitor each have a capacitance value less than or equal to 5 picofarads (pF). In some embodiments, the transient feedback circuit includes a first feedback transistor coupled between a high supply line and a feedback node, a second feedback transistor coupled between a low supply line and the feedback node, a bias circuit coupled to the first feedback transistor and the second feedback transistor, and a capacitive differentiator circuit coupled to the output terminal and coupled to a control terminal of the first feedback transistor and a control terminal of the second feedback transistor. In such embodiments, the feedback node is coupled to the primary feedback loop.

In various embodiments, the transient feedback circuit includes a first feedback transistor coupled to the primary feedback loop, a second feedback transistor coupled to the first feedback transistor and a low supply line, a first bias circuit coupled to the first feedback transistor and the second feedback transistor, and a first feedback capacitor coupled to the output terminal and coupled to a control terminal of the second feedback transistor. In some embodiments, the transient feedback circuit includes a third feedback transistor coupled to the primary feedback loop, a fourth feedback transistor coupled to the third feedback transistor and a low supply line, a second bias circuit coupled to the third feedback transistor and the fourth feedback transistor, and a second feedback capacitor coupled to the output terminal and coupled to an intermediate node between the third feedback transistor and the fourth feedback transistor.

In various embodiments, the primary feedback loop includes a current mirror having a first branch and a second branch, an output transistor coupled to the first branch and coupled to the output terminal, and an output feedback transistor coupled to the feedback node. In such embodiments, the second branch is coupled to a feedback node and the feedback node is coupled to a conduction terminal of the output feedback transistor, a control terminal of the output feedback transistor, and a control terminal of the output transistor. In some embodiments, the primary feedback loop includes a positive current feedback loop. In some particular embodiments, no off-chip capacitor is coupled to the output terminal.

According to an embodiment, a method of generating a regulated output voltage includes receiving an input voltage, generating the regulated output voltage at an output terminal based on the input voltage, regulating the regulated output voltage using a primary feedback loop, and providing a first current with a first polarity to the primary feedback loop from a transient feedback circuit when current flowing through the output terminal is increasing. Other embodiments include corresponding systems and apparatus, each configured to perform corresponding embodiment methods.

Implementations may include one or more of the following features. In various embodiments, the transient feedback circuit has a faster response time than the primary feedback loop. In some embodiments, the method further includes providing a second current with a second polarity to a reference node in the primary feedback loop with a current subtractor circuit when current flowing through the output terminal is increasing, where the second polarity is opposite the first polarity. Providing the first current with the first polarity to the primary feedback loop from the transient feedback circuit may include generating a transient feedback control signal using a capacitive differentiator coupled to the output terminal and regulating a transient feedback current that is coupled to the primary feedback loop based on the transient feedback control signal. Regulating the regulated output voltage using the primary feedback loop may include positive current feedback that includes, when current flowing through the output terminal is increasing, increasing a current flowing in the primary feedback loop, increasing a voltage supplied to a control terminal of an output transistor configured to supply the output terminal based on increasing the current flowing in the primary feedback loop, and increasing current flowing through the output terminal based on increasing the voltage supplied to the control terminal of the output transistor; and, when current flowing through the output terminal is decreasing, decreasing the current flowing in the primary feedback loop, decreasing the voltage supplied to the control terminal of the output transistor based on decreasing the current flowing in the primary feedback loop, and decreasing current flowing through the output terminal based on decreasing the voltage supplied to the control terminal of the output transistor. In some specific embodiments, no off-chip capacitor is coupled to the output terminal.

According to an embodiment, a voltage regulator includes a linear voltage regulator (LVR) that includes a primary feedback loop, an input terminal configured to receive an input voltage, and an output terminal configured to output a regulated voltage. The voltage regulator also includes a current subtractor circuit coupled to the primary feedback loop and configured to provide a first current with a first polarity to a reference node in the primary feedback loop when current flowing through the output terminal is increasing. Other embodiments include corresponding systems and apparatus, each configured to perform corresponding embodiment methods.

Implementations may include one or more of the following features. In various embodiments, the voltage regulator further includes a transient feedback circuit coupled to the output terminal and the primary feedback loop, where the transient feedback circuit is configured to provide a second current with a second polarity to the primary feedback loop when current flowing through the output terminal is increasing, and where the second polarity is opposite the first polarity. In some embodiments, the current subtractor circuit includes a current mirror having a first branch and a second branch, and a control transistor coupled to the second branch. In such embodiments, the first branch coupled to the reference node and a control terminal of the control transistor is coupled to a control node of the primary feedback loop.

In various embodiments, the primary feedback loop includes a current mirror having a first branch and a second branch, an output transistor coupled to the first branch and coupled to the output terminal, and an output feedback transistor coupled to the feedback node. In such embodiments, the second branch is coupled to a feedback node and the feedback node is coupled to a conduction terminal of the output feedback transistor, a control terminal of the output feedback transistor, and a control terminal of the output transistor. In some embodiments, the primary feedback loop includes a positive current feedback loop. In some specific embodiments, no off-chip capacitor is coupled to the output terminal.

According to an embodiment, a method of generating a regulated output voltage includes receiving an input voltage, generating the regulated output voltage at an output terminal based on the input voltage, regulating the regulated output voltage using a primary feedback loop, and providing a first current with a first polarity to a reference node in the primary feedback loop with a current subtractor circuit when current flowing through the output terminal is increasing. Other embodiments include corresponding systems and apparatus, each configured to perform corresponding embodiment methods.

Implementations may include one or more of the following features. In various embodiments, the method further includes providing a second current with a second polarity to the primary feedback loop from a transient feedback circuit when current flowing through the output terminal is increasing. In such embodiments, the second polarity is opposite the first polarity. In some embodiments, providing the first current with the first polarity to the reference node in the primary feedback loop with the current subtractor circuit includes drawing an additional current out of the reference node into a first branch of a current mirror, mirroring the additional current in a second branch of the current mirror, drawing the additional current through a control transistor coupled to the second branch of the current mirror, and providing a control signal to the primary feedback loop based on the additional current drawn through the control transistor. Regulating the regulated output voltage using the primary feedback loop may include positive current feedback that includes, when current flowing through the output terminal is increasing, increasing a current flowing in the primary feedback loop, increasing a voltage supplied to a control terminal of an output transistor configured to supply the output terminal based on increasing the current flowing in the primary feedback loop, and increasing current flowing through the output terminal based on increasing the voltage supplied to the control terminal of the output transistor; and, when current flowing through the output terminal is decreasing, decreasing the current flowing in the primary feedback loop, decreasing the voltage supplied to the control terminal of the output transistor based on decreasing the current flowing in the primary feedback loop, and decreasing current flowing through the output terminal based on decreasing the voltage supplied to the control terminal of the output transistor. In some specific embodiments, no off-chip capacitor is coupled to the output terminal.

Advantages of the various embodiments described herein may include LVRs with improved transient response characteristics and reduced variation in the regulated output voltage. Embodiments described herein may include reference voltage nodes with low impedance and stable voltage along with a feedback loop that has a fast transient feedback path for stable regulated output voltages with improved transient response.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A voltage regulator comprising:

a linear voltage regulator (LVR) comprising:

an output transistor coupled between an input terminal and an output terminal, the output transistor having a gate coupled to a feedback node, a primary feedback loop comprising a first output feedback transistor having a gate coupled to the feedback node and a first conduction terminal coupled to a reference node, wherein the input terminal is configured to receive an input voltage, and the output terminal is configured to output a regulated voltage;

a transient feedback circuit coupled to the output terminal and the primary feedback loop, wherein the transient feedback circuit is configured to increase a gate to source voltage of the output transistor when current flowing through the output terminal is increasing; and a current subtractor circuit coupled to the primary feedback loop and configured to stabilize voltage variations of the reference node by sinking current from the reference node when current flowing into the reference node increases.

2. The voltage regulator of claim 1, wherein the current subtractor circuit comprises:

a current mirror having a first branch and a second branch, the first branch coupled to the reference node; and a control transistor coupled to the second branch, wherein a control terminal of the control transistor is coupled to a control node of the primary feedback loop.

3. The voltage regulator of claim 1, wherein the transient feedback circuit has a faster response time than the primary feedback loop.

4. The voltage regulator of claim 1, wherein the transient feedback circuit comprises a first feedback capacitor coupled to the output terminal and a second feedback capacitor coupled to the output terminal.

5. The voltage regulator of claim 4, wherein the first feedback capacitor and the second feedback capacitor each have a capacitance value less than or equal to 5 picofarads (pF).

6. The voltage regulator of claim 1, wherein the transient feedback circuit comprises:

a first feedback transistor coupled between a high supply line and the feedback node;

a second feedback transistor coupled between a low supply line and the feedback node;

a bias circuit coupled to the first feedback transistor and the second feedback transistor; and a capacitive differentiator circuit coupled to the output terminal and coupled to a control terminal of the first feedback transistor and a control terminal of the second feedback transistor.

7. The voltage regulator of claim 1, wherein the transient feedback circuit comprises:

a first feedback transistor coupled to the primary feedback loop;

a second feedback transistor coupled to the first feedback transistor and a low supply line;

a first bias circuit coupled to the first feedback transistor and the second feedback transistor; and a first feedback capacitor coupled to the output terminal and coupled to a control terminal of the second feedback transistor.

8. A voltage regulator comprising:

a linear voltage regulator (LVR) comprising:

a primary feedback loop, an input terminal configured to receive an input voltage, and an output terminal configured to output a regulated voltage; and a transient feedback circuit coupled to the output terminal and the primary feedback loop, wherein the transient feedback circuit is configured to provide a first current with a first polarity to the primary feedback loop when current flowing through the output terminal is increasing, wherein the transient feedback circuit comprises:

a first feedback transistor coupled to the primary feedback loop, a second feedback transistor coupled to the first feedback transistor and a low supply line a first bias circuit coupled to the first feedback transistor and the second feedback transistor, a first feedback capacitor coupled to the output terminal and coupled to a control terminal of the second feedback transistor, a third feedback transistor coupled to the primary feedback loop, a fourth feedback transistor coupled to the third feedback transistor and a low supply line, a second bias circuit coupled to the third feedback transistor and the fourth feedback transistor, and a second feedback capacitor coupled to the output terminal and coupled to an intermediate node between the third feedback transistor and the fourth feedback transistor.

9. The voltage regulator of claim 1, wherein:

the primary feedback loop further comprises a current mirror having a first branch and a second branch, wherein the second branch is coupled to the feedback node; and the gate of the first output feedback transistor is coupled to a second conduction terminal of the first output feedback transistor.

10. The voltage regulator of claim 1, wherein the primary feedback loop comprises a positive current feedback loop.

11. The voltage regulator of claim 1, wherein no off-chip capacitor is coupled to the output terminal.

12. A method of generating a regulated output voltage, the method comprising:

receiving an input voltage at an input terminal coupled to a first conduction terminal of an output transistor;

generating the regulated output voltage at an output terminal coupled to a second conduction terminal of the output transistor, the output transistor having a gate coupled to a feedback node;

regulating the regulated output voltage based on a reference voltage of a reference node using a primary feedback loop comprising a first output feedback transistor having a gate coupled to the feedback node and a first conduction terminal coupled to the reference node;

increasing a gate to source voltage of the output transistor by using a transient feedback circuit coupled to the output terminal and the primary feedback loop when current flowing through the output terminal is increasing; and stabilizing voltage variations of the reference node by sinking current from the reference node with a current subtractor circuit when current flowing into the reference node increases.

13. The method of claim 12, wherein the transient feedback circuit has a faster response time than the primary feedback loop.

14. The method of claim 12, increasing the gate to source voltage of the output transistor comprises:

generating a transient feedback control signal using a capacitive differentiator coupled to the output terminal; and regulating a transient feedback current that is coupled to the primary feedback loop based on the transient feedback control signal.

15. The method of claim 12, wherein regulating the regulated output voltage using the primary feedback loop comprises positive current feedback that comprises:

when current flowing through the output terminal is increasing:

increasing a current flowing in the primary feedback loop, and increasing current flowing through the output terminal based on increasing the gate to source voltage of the output transistor; and when current flowing through the output terminal is decreasing:

decreasing the current flowing in the primary feedback loop, decreasing the gate to source voltage of the output transistor based on decreasing the current flowing in the primary feedback loop, and decreasing current flowing through the output terminal based on decreasing the gate to source voltage of the output transistor.

16. The method of claim 12, wherein no off-chip capacitor is coupled to the output terminal.

17. A voltage regulator comprising:

a linear voltage regulator (LVR) comprising:

an output transistor coupled between an input terminal and an output terminal, the output transistor having a gate coupled to a feedback node, a primary feedback loop comprising a first output feedback transistor having a gate coupled to the feedback node and a first conduction terminal coupled to a reference node, wherein the input terminal is configured to receive an input voltage, and the output terminal configured to output a regulated voltage; and a current subtractor circuit coupled to the primary feedback loop and configured to stabilize voltage variations of the reference node by sinking current from the reference node when current flowing into the reference node is increasing.

18. The voltage regulator of claim 17, further comprising a transient feedback circuit coupled to the output terminal and the primary feedback loop, wherein the transient feedback circuit is configured to provide a current to the primary feedback loop when current flowing through the output terminal is increasing.

19. The voltage regulator of claim 17, wherein the current subtractor circuit comprises:

a current mirror having a first branch and a second branch, the first branch coupled to the reference node; and a control transistor coupled to the second branch, wherein a control terminal of the control transistor is coupled to a control node of the primary feedback loop.

20. The voltage regulator of claim 17, wherein the primary feedback loop comprises a current mirror having a first branch and a second branch, wherein the second branch is coupled to the feedback node, and wherein the feedback node is coupled to a second conduction terminal of the first output feedback transistor.

21. The voltage regulator of claim 17, wherein the primary feedback loop comprises a positive current feedback loop.

22. The voltage regulator of claim 17, wherein no off-chip capacitor is coupled to the output terminal.

23. A method of generating a regulated output voltage, the method comprising:

receiving an input voltage at an input terminal coupled to a first conduction terminal of an output transistor;

generating the regulated output voltage at an output terminal coupled to a second conduction terminal of the output transistor, the output transistor having a gate coupled to a feedback node;

regulating the regulated output voltage based on a reference voltage of a reference node using a primary feedback loop comprising a first output feedback transistor having a gate coupled to the feedback node and a first conduction terminal coupled to the reference node; and stabilizing voltage variations of the reference node by sinking current from the reference node with a current subtractor circuit when current flowing into the reference node is increasing.

24. The method of claim 23, further comprising providing a current to the primary feedback loop from a transient feedback circuit when current flowing through the output terminal is increasing.

25. A method of generating a regulated output voltage, the method comprising:

receiving an input voltage;

generating the regulated output voltage at an output terminal;

regulating the regulated output voltage using a primary feedback loop; and providing a first current with a first polarity to a reference node in the primary feedback loop with a current subtractor circuit when current flowing through the output terminal is increasing, wherein providing the first current with the first polarity to the reference node in the primary feedback loop with the current subtractor circuit comprises:

drawing an additional current out of the reference node into a first branch of a current mirror;

mirroring the additional current in a second branch of the current mirror;

drawing the additional current through a control transistor coupled to the second branch of the current mirror; and providing a control signal to the primary feedback loop based on the additional current drawn through the control transistor.

26. The method of claim 25, wherein regulating the regulated output voltage using the primary feedback loop comprises positive current feedback that comprises:

when current flowing through the output terminal is increasing:

increasing a current flowing in the primary feedback loop, increasing a voltage supplied to a control terminal of an output transistor configured to supply the output terminal based on increasing the current flowing in the primary feedback loop, and increasing current flowing through the output terminal based on increasing the voltage supplied to the control terminal of the output transistor; and when current flowing through the output terminal is decreasing:

decreasing the current flowing in the primary feedback loop, decreasing the voltage supplied to the control terminal of the output transistor based on decreasing the current flowing in the primary feedback loop, and decreasing current flowing through the output terminal based on decreasing the voltage supplied to the control terminal of the output transistor.

27. The method of claim 23, wherein no off-chip capacitor is coupled to the output terminal.

28. The voltage regulator of claim 6, wherein the first feedback transistor comprises a drain terminal directly connected to a drain terminal of the second feedback transistor.

29. The voltage regulator of claim 1, further comprising:

a first p-type transistor coupled between the reference node and ground;

a differential amplifier having a non-inverting input configured to receive a reference voltage and an output coupled to a gate of the first p-type transistor; and a second p-type transistor coupled between an inverting input of the differential amplifier and ground and having a gate coupled to the output of the differential amplifier.

* * * * *